United States Patent [19]

Coles, Jr.

[11] 4,030,858

[45] June 21, 1977

[54] MULTI-STAGE RABBIT

[76] Inventor: Otis C. Coles, Jr., P.O. Box 12155, El Paso, Tex. 79912

[22] Filed: Sept. 29, 1975

[21] Appl. No.: 617,715

[52] U.S. Cl. ..... 417/56

[51] Int. Cl.[2] ..... F04B 47/12

[58] Field of Search ..... 417/56–60, 417/430; 92/193; 137/330, 331

[56] References Cited

UNITED STATES PATENTS

| | | | |
|---|---|---|---|
| 1,393,953 | 10/1921 | Miller | 417/430 |
| 1,855,554 | 4/1932 | LaBrie | 92/193 X |
| 1,976,151 | 10/1934 | Thaheld | 417/430 X |
| 2,684,633 | 7/1954 | Knox | 417/60 |
| 3,150,596 | 9/1964 | Knox | 417/60 |
| 3,424,066 | 1/1969 | Moore, Jr. | 417/56 X |
| 3,451,067 | 6/1969 | Jordan | 137/331 X |

*Primary Examiner*—William L. Freeh
*Assistant Examiner*—Edward Look
*Attorney, Agent, or Firm*—Clarence A. O'Brien; Harvey B. Jacobson

[57] ABSTRACT

Two or more independently expansible packer devices mounted on the mandrel of a free piston plunger assembly are axially separated by intermediate spacer sleeves through which the packer devices are keyed to the mandrel. Flow-conducting gaps between arcuate segments of the packer devices extend at an angle to the axis of the mandrel to impart rotation to the plunger assembly during axial reciprocation.

13 Claims, 7 Drawing Figures

MULTI-STAGE RABBIT

This invention relates to improvements in a free piston type of plunger assembly commonly utilized in oil or gas wells.

Fluid lift plunger assemblies are commonly utilized in oil or gas wells, such tools being sometimes referred to as a "rabbit." Generally, the plunger assembly is reciprocated within the tube string extending into the well by means of gas pressurized under valve control, the gas being either injected into the well or derived from a natural formation of gas or oil. The plunger drops toward the bottom of the well within the tube string when pressure is equalized and in response to a pressure differential imposed thereon, the plunger assembly rises in wiping engagement with the inside of the tube string to lift fluid to the surface. Plunger assemblies of the foregoing type are disclosed, for example, in U.S. Pat. Nos. 2,962,978, 3,012,832, 3,181,470, 3,424,093 and 3,424,066.

The foregoing type of free piston plunger presently in use suffers from various drawbacks, including its inability to adequately and uniformly seal the fluid being lifted, the tendency to wear grooves in the walls of the tube string, and the tendency to become disassembled after continuous heavyduty use. It is, therefore, an important object of the present invention to provide a free piston type of plunger assembly for oil or gas wells or the like that overcomes the aforementioned drawbacks of prior plunger assemblies.

In accordance with the present invention, the plunger assembly includes a main body or mandrel providing for multi-stage wiping contact with the inside of the tube string by means of two or more independently expansible packer devices that are axially separated by spacer sleeves press fitted on and keyed to the mandrel. Each of the packer devices is formed of at least four arcuate segments, the segments being circumferentially spaced from each other in each packer device by gaps forming fluid passages or channels that extend at an angle to the longitudinal axis of the plunger assembly. Accordingly, fluid conducted through the gaps during reciprocation of the plunger assembly imparts rotation to the plunger assembly about its longitudinal axis in order to avoid the formation of grooves because of wear and to produce a cleaning effect on the inside of the tube string. The segments of the packer devices are, therefore, locked to the spacer sleeve for preventing relative rotation between the segments and the mandrel. Springs bias the segments radially outwardly into wiping contact with the inside of the tube string augmented by centrifugal force to enhance sealing. The provision of axially spaced packer devices ensures an adequate wiping seal while the plunger assembly is passing irregularities or collar joints in the tubing. The use of four or more segments in each packer device also provides for a better wiping seal. The spacer sleeves as well as the radially enlarged sections of the mandrel adjacent its opposite longitudinal ends are additionally locked to the main tubular body of the mandrel by tapered pins to prevent unintended disassembly.

These together with other objects and advantages which will become subsequently apparent reside in the details of construction and operation as more fully hereinafter described and claimed, reference being had to the accompanying drawings forming a part hereof, wherein like numerals refer to like parts throughout.

Figure 1:
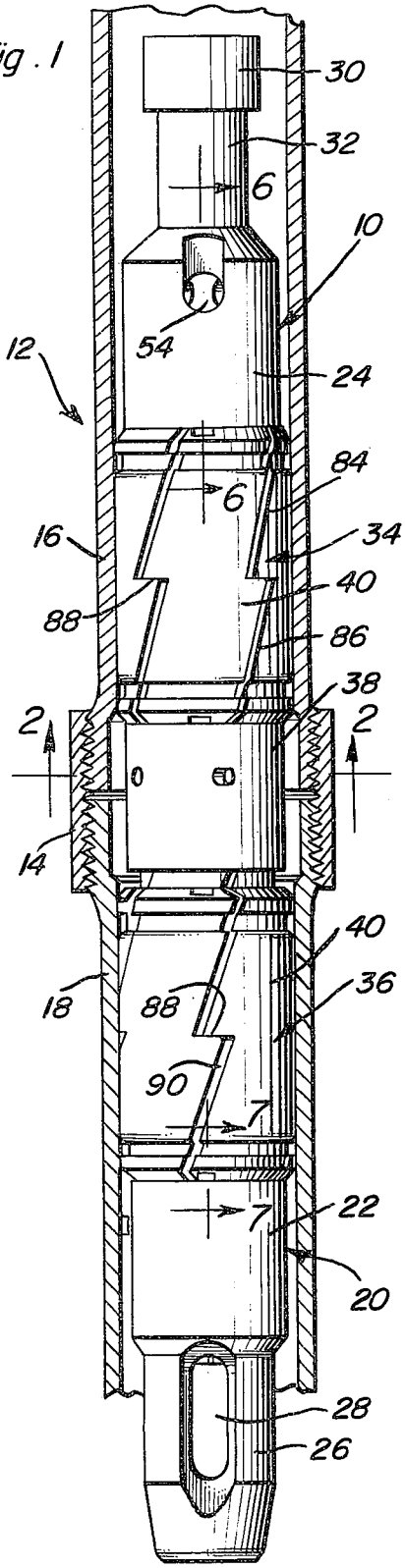
FIG. 1 is a section view through a tube string showing a plunger assembly constructed in accordance with the present invention, in side elevation.

Referring now to the drawings in detail, FIG. 1 illustrates the plunger assembly of the present invention generally referred to by reference numeral 10 installed within a vertical tube string generally referred to by reference numeral 12, the plunger assembly being reciprocated by a pneumatic differential pressure applied in a manner well known to those skilled in the art. As shown in FIG. 1, the plunger assembly 10 is traveling past a collar joint 14 interconnecting the upset end portion of two adjacent tube sections 16 and 18 of the tubing string.

With continued reference to FIG. 1, the plunger assembly includes an elongated body generally referred to by reference numeral 20 having a diametrically enlarged section 22 adjacent its lower end and a diametrically enlarged section 24 adjacent its upper end. The lower end portion 26 is provided with openings 28 through which fluid is conducted into the plunger assembly as it is falling in response to pressure equalization that occurs when the flow valve of the well is shut. The upper end of the elongated body 20 is provided with a fishing enlargement 30 spaced from the section 24 by a neck portion 32. By way of example, two independently expansible packer devices 34 and 36 are shown mounted on the elongated body respectively in abutment with the sections 24 and 22 and spaced from each other by a spacer sleeve 38, the spacer sleeve being keyed to the body 20, as will be explained hereafter. The packer devices 34 and 36 are of the same construction and assembly, and each includes at least four arcuate segments 40. The segments 40 of the respective packer devices 34 and 36, as assembled, are circumferentially spaced relative to each other as depicted in FIG. 1. It should be appreciated that if more than two packer devices are utilized, each pair of adjacent packer devices will be separated by a spacer sleeve 38.

Figure 5:
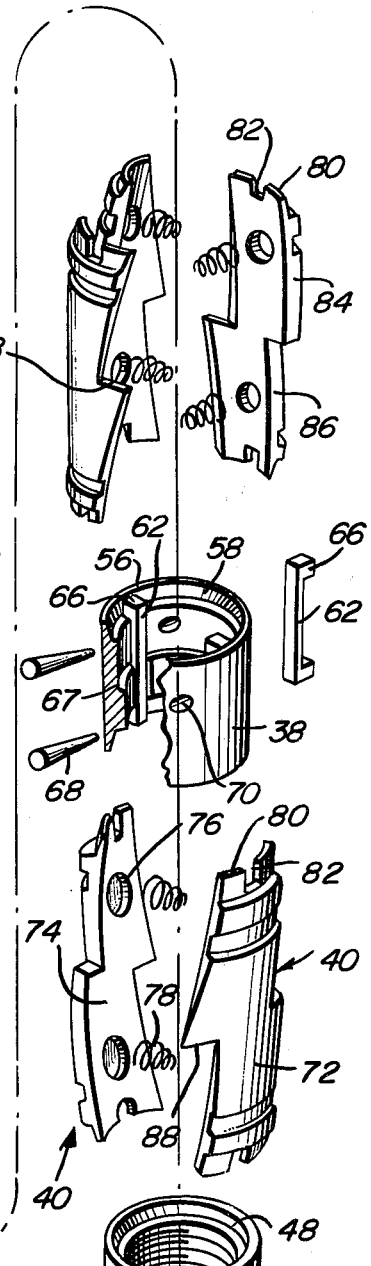
FIG. 5 is an exploded perspective view showing the various parts of the plunger assembly.

As more clearly seen in FIG. 5, the elongated body 20 includes a tubular mandrel 42 to which the section 24 is connected adjacent the upper end. The lower end portion of the tubular mandrel is threaded at 44 for connection to the lower section 22. Chamfered annular channels 46 and 48 are respectively formed about the tubular mandrel 42 by the enlarged sections 24 and 22. An intermediate collar formation 50 is also formed on the tubular mandrel axially between the sections 22 and 24. A central bore 52 formed within the mandrel 42 is in fluid communication with the exterior of the plunger assembly adjacent its upper end through slots 54 formed in the enlarged section 24.

Figure 2:
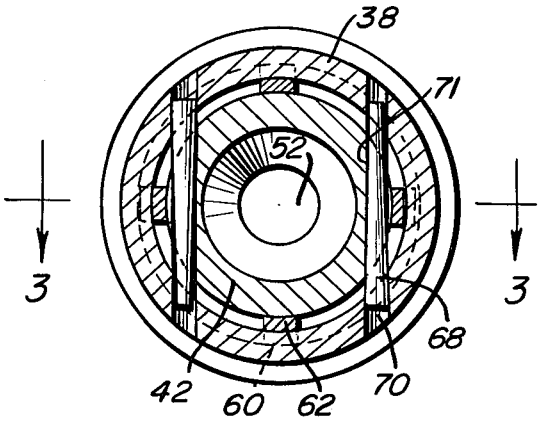
FIG. 2 is a transverse section view taken substantially through a plane indicated by section line 2—2 in FIG. 1.

The spacer sleeve 38 is formed with tapered edges 56 at its opposite axial ends to form annular channels 58, as more clearly seen in FIG. 5, about the mandrel to which it is keyed by means of the collar formation 50. The inside surface of the spacer sleeve is, therefore, provided with a plurality of longitudinal slots 60 receiving keys 62 that fit within corresponding slots 64 formed in the collar formation 50. The opposite longitudinal ends of each key 62 is provided with enlargements 66 that project into the annular channels 58. To more firmly secure the spacer sleeve to the mandrel 42, the sleeve is press fitted onto the collar 50 which abuts an internal shoulder 67. Tapered pins 68 are also inserted through aligned tapered bores 70 and 71 which extend through the spacer sleeve 38 and the tubular mandrel 42, as more clearly seen in FIG. 2. Pins 68 also additionally secure the lower end sections 22 to the mandrel. Where more than two packer devices are utilized, the plunger assembly is made longer and additional collar formations may be keyed to the mandrel for spacing adjacent packer devices. In such case, each additional collar is formed from split sections.

Figure 3:
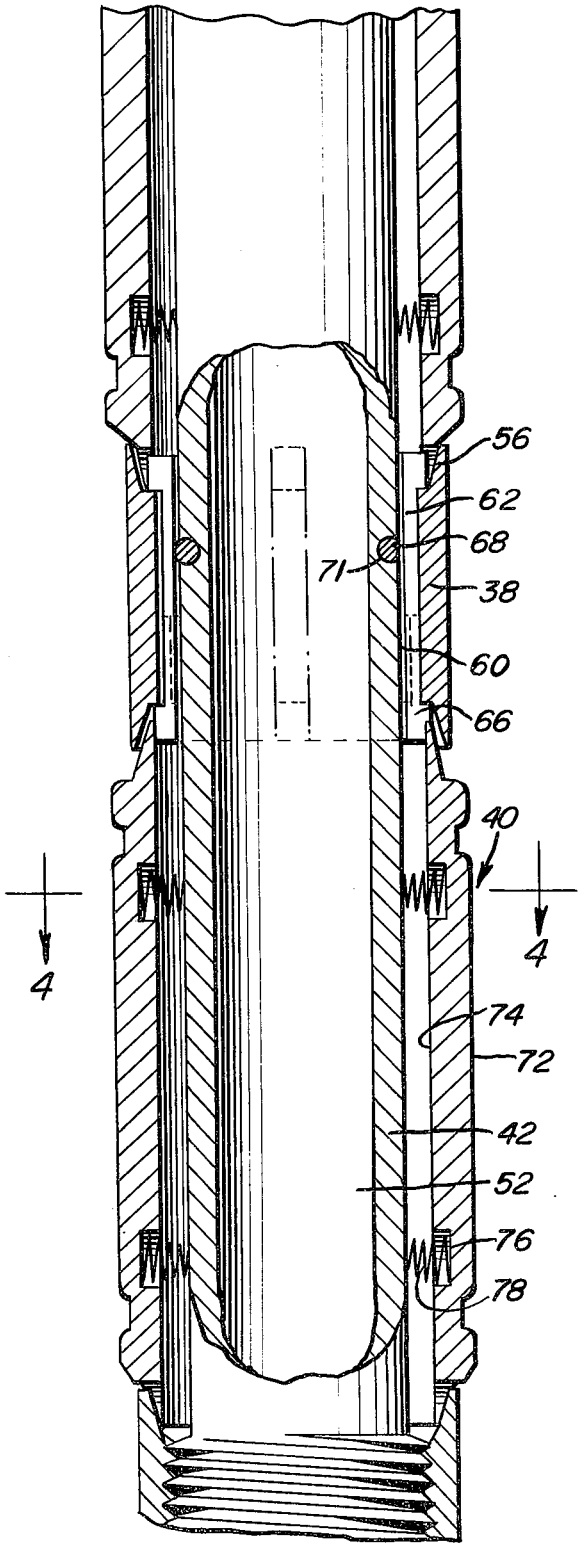
FIG. 3 is an enlarged partial sectional view with parts broken away showing a portion of the assembly illustrated in FIG. 1.
Figure 4:
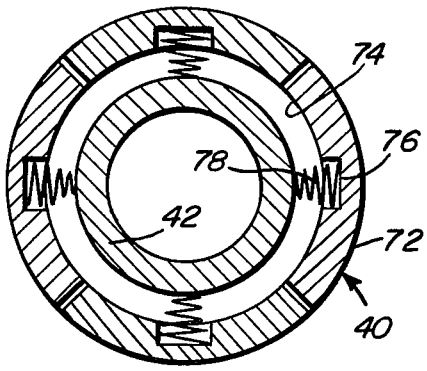
FIG. 4 is a sectional view taken substantially through a plane indicated by section line 4—4 in FIG. 3.
Figure 4:
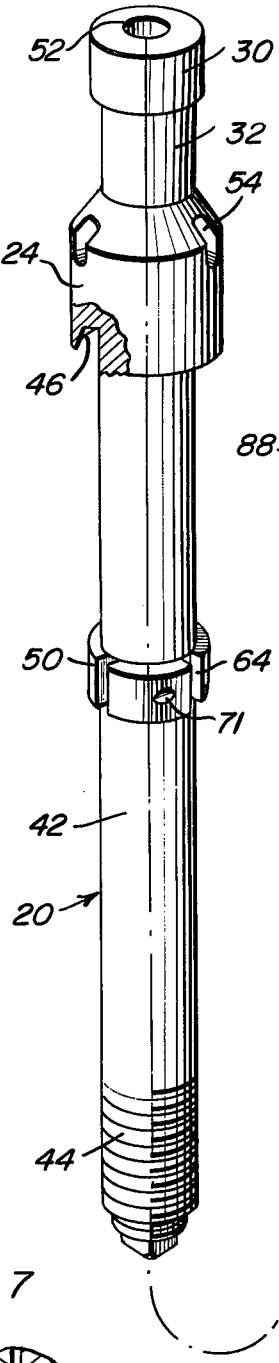

As hereinbefore indicated, each of the packer devices 34 and 36 is of the same construction and assembly and includes the aforementioned arcuate segments 40. As more clearly seen in FIG. 5, each segment 40 includes an external surface 72 adapted to wipingly contact the inside surface of the tubing string 12. The inside arcuate surface 74 of each segment, on the other hand, is provided with circular recesses 76 adapted to seat the large diameter end of a conical spring 78. When assembled, each of the springs 78 bears against the mandrel 42 at its small diameter end, as more clearly seen in FIGS. 3 and 4. The opposite arcuate edge portions 80 of each segment are chamfered so as to readily fit into one of the annular channels 46, 48 and 58 associated with the enlarged sections 22 and 24 and the spacer sleeve 38. The chamfered edge portion 80 and receiving channels 46, 48 and 58 provide adequate thrust bearing surfaces for absorbing impact at the ends of the reciprocating strokes of the plunger assembly. Each of the chamfered edge portions 80 of the segments is provided with a notch 82 in order to receive an enlargement 66 of the key 62. It will be appreciated that the foregoing construction of the segments is such that they may be interchangeable between the two packer devices 34 and 36.

Each of the packer segments 40 is provided with edge portions 84 and 86 on each longitudinal side of the segment, the edge portions being interconnected by step surfaces 88. Thus, adjacent segments are loosely held assembled to each other with the step surfaces 88 in abutment while the edge portions 84 and 86 are spaced apart to form flow-conducting gaps 90 constitution passages or channels therebetween, as more clearly seen in FIG. 1. It will also be apparent from FIG. 1 that the step surfaces 88 slidingly abut each other in planes perpendicular to the longitudinal axis of the plunger assembly while the flow-conducting gaps 90 extend at an angle to the longitudinal axis of the plunger assembly.

Figure 6:
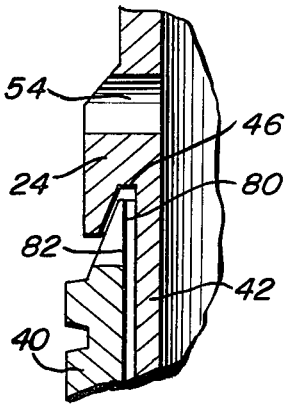
FIG. 6 is an enlarged partial sectional view taken substantially through a plane indicated by section line 6—6 in FIG. 1.
Figure 7:
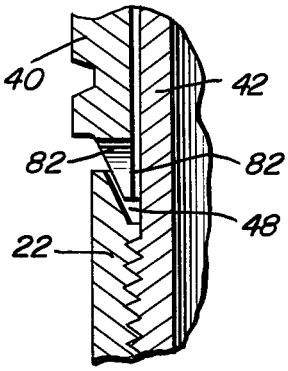
FIG. 7 is an enlarged partial sectional view taken substantially through a plane indicated by section line 7—7 in FIG. 1.
Figure 7:
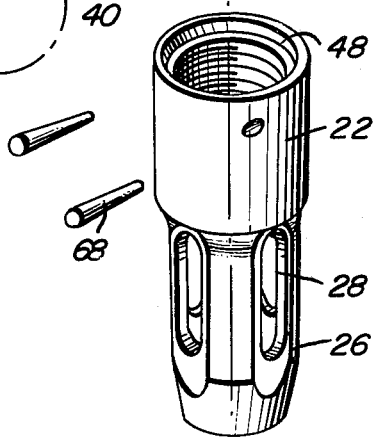

The plunger assembly 10 operates in a manner well known to those skilled in the art. However, in accordance with the present invention the two or more axially spaced packer devices 34 and 36 are independently expansible into wiping contact with the inside of the tube string so as to ensure an adequate wiping seal. If any irregularity such as that which sometimes exists at a collar joint, disturbs the seal provided by one of the packer devices, the other packer device will continue to provide adequate sealing so as to avoid loss of fluid during the fluid lift phase of operation. Furthermore, during reciprocation of the plunger assembly, there will be a certain amount of flow of fluid through the gaps 90 between the segments 40 of the packer devices. Inasmuch as the gaps 90 are at an angle to the longitudinal axis of the plunger assembly, this flow of fluid will impose a rotational force component on the segments which are locked against rotation relative to the main body or mandrel 42 of the plunger assembly, Toward that end, the enlargements 66 on the keys 62 are received within the notches 82 at the end edge portions 80 of the segments as aforementioned. The end edge portions 80 of the segments 40, also hold the segments loosely assembled by being received within the annular channels 46 and 48 in the enlarged sections 24 and 22, as more clearly seen in FIGS. 6 and 7. The tapered pins 68, furthermore, ensure that the plunger assembly will not become disassembled and accordingly augment the non-rotative connections established by the keys 62 and the threads 44.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A plunger assembly adapted to be pneumatically reciprocated within an eductor tube string along a longitudinal axis for lifting fluid in an annular passage formed between the tube string and the plunger assembly, comprising an elongated mandrel having a radially enlarged section adjacent an upper longitudinal end thereof, and a radially expansible packer device mounted on the mandrel in abutment with said radially enlarged section for wiping engagement with the tube string, and packer device including passage means responsive to directed flow of the fluid from said annular passage therethrough during reciprocation of the packer device in wiping contact with the tube string for imparting rotation to the plunger assembly about said longitudinal axis.

2. The combination of claim 1 wherein said packer device includes a plurality of arcuate segments radially displaceable relative to each other from the mandrel and spring means biasing said segments radially outwardly toward the tube string, said passage means being formed by flow conducting gaps between the segments extending longitudinally at an angle to said longitudinal axis.

3. The combination of claim 2 wherein each of said segments includes a radially outer sealing surface engageable with the tube string, a radially inner surface having recesses seating the spring means, longitudinal side edges between which the outer and inner surfaces extend and chamfered end edges one of which abuts the enlarged section of the mandrel, said side edges having at least two portions circumferentially spaced relative to each other and inter-connected by a step surface, the confronting side edges of adjacent ones of the segments forming said flow conducting gaps.

4. The combination of claim 3 wherein said enlarged section of the mandrel includes a channel forming flange within which said one of the end edges of the segments are received.

5. The combination of claim 4 wherein said mandrel further includes an intermediate collar formation, a spacer sleeve having an axial abutment channel within which the other of the end edges of the segments are received, and key means extending radially between the collar formation and the spacer sleeve for locking the sleeve against rotation relative to the mandrel, said other of the end edges of the segments being formed with notches receiving the key means to also lock the segments against rotation relative to the mandrel.

6. The combination of claim 5 including tapered pins locking the spacer sleeve to the mandrel.

7. A multi-stage plunger assembly adapted to be pneumatically reciprocated within an eductor tube string along a longitudinal axis for lifting fluid in an annular passage formed between the tube string and the plunger assembly, comprising an elongated mandrel having at least two independently expansible packer devices mounted on the mandrel wherein each of said packer devices includes a plurality of arcuate segments radially displaceable relative to each other from the mandrel, spring means biasing said segments radially outwardly toward the tube string, said segments having means forming flow conducting gaps between the segments extending longitudinally at an angle to said longitudinal axis for conducting flow of the fluid from said annular passage to impart rotation to the mandrel about said axis, and spacer means keyed to the mandrel for axially separating the packer devices and tramsmitting torque between the mandrel and the packer devices.

8. The combination of claim 7 wherein said mandrel has radially enlarged sections and each of said segments includes a radially outer sealing surface engageable with the tube string, a radially inner surface having recesses seating the spring means, longitudinal side edges between which the outer and inner surfaces extend and chamfered end edges abutting the radially enlarged sections and the spacer sleeve, said enlarged sections and the spacer means being formed with annular channels receiving the end edges of the segments.

9. The combination of claim 7 wherein the segments respectively associated with the packer devices are circumferentially spaced relative to each other.

10. In combination with a tube string, a plunger assembly reciprocated therein along a common longitudinal axis to displace fluid in an annular passage formed between tube string and the plunger assembly, said plunger assembly including a mandrel, a packer device non-rotatively fixed to the mandrel having sealing surface means for wiping contact with the tube string during reciprocation of the plunger assembly to cause displacement of the fluid in the annular passage, and biasing means mounted on the mandrel for expansion of the sealing surface means into wiping contact with the tube string, and passage means formed in said sealing surface means of the packer device in response to said expansion thereof for receiving fluid from the annular passage to impart rotation to the plunger assembly during reciprocation thereof.

11. The combination of claim 10 wherein said passage means includes longitudinal channels extending at an angle to the longitudinal axis in fluid communication with the annular passage.

12. The combination of claim 11 wherein said sealing surface means includes a plurality of arcuate segments that are radially displaceable relative to the longitudinal axis under the urge of said biasing means to form circumferentially spaced gaps therebetween constituting said channels.

13. The combination of claim 12 wherein said segments abut each other on slide surfaces perpendicular to the longitudinal axis, said channels extending from the slide surfaces.

* * * * *